US006155471A

United States Patent [19]

Lichtenberger

[11] Patent Number: 6,155,471

[45] Date of Patent: Dec. 5, 2000

[54] DRILL MOTOR SHOULDER POUCH ASSEMBLY

[76] Inventor: Daniel David Lichtenberger, 2161 Bluebell Dr., Livermore, Calif. 94550

[21] Appl. No.: 09/293,621

[22] Filed: Apr. 16, 1999

Related U.S. Application Data

[63] Continuation-in-part of application No. 29/081,528, Jan. 5, 1998.

[51] Int. Cl.[7] ..... A45F 3/02

[52] U.S. Cl. ..... 224/626; 224/242; 224/604; 224/605; 224/608; 224/613; 224/625; 224/680

[58] Field of Search ..... 224/607, 608, 224/623, 624, 904, 911, 192, 603, 604, 605, 625, 626, 600, 601, 602, 606, 613, 614, 616, 223, 660, 677, 680, 242, 257, 929, 930

[56] References Cited

U.S. PATENT DOCUMENTS

| | | | |
|---|---|---|---|
| 3,797,715 | 3/1974 | Scialdone | 224/623 X |
| 4,279,367 | 7/1981 | Jacobs | 224/257 |
| 4,828,154 | 5/1989 | Clifton, Jr. | 224/904 |
| 4,917,281 | 4/1990 | Ostermiller | 224/623 X |
| 5,009,346 | 4/1991 | Butler | 224/605 |
| 5,400,935 | 3/1995 | Farmer | 224/623 |
| 5,624,065 | 4/1997 | Steffe | 224/625 |

*Primary Examiner*—Stephen K. Cronin
*Attorney, Agent, or Firm*—George W. Wasson; Mark Blumenkrantz

[57] ABSTRACT

A drill motor carrying pouch to carry a drill motor on the upper torso has a pouch angled and shaped to allow for various types, styles and sizes of drill motors and such other undefined objects desirous to be carried. The shoulder pouch assembly has a drill motor pouch with an accessory containment unit on the front, a fully adjustable strap assembly supporting the drill motor pouch containing the drill motor and a safety strap to secure the drill motor in the drill motor pouch. It may be designed for left handed persons, and has a separate design for right handed persons. The fully adjustable strap assembly may have a section of widened and padded strap for the area near and around the shoulder and neck. The shoulder pouch assembly has an attachable and detachable drill motor bit and accessory holder for containing associated and non-associated objects able to be conveniently located on the fully adjustable strap assembly or other objects of which it may be able to be attached. The accessory holder for containing associated and non-associated objects has a plurality of accessory storage capabilities of which the front may be configured.

19 Claims, 6 Drawing Sheets

DRILL MOTOR SHOULDER POUCH ASSEMBLY

Cross References to Related Application

This is a continuation-in-part of Ser. No. 29/081,528 filed on Jan. 5, 1998.

BACKGROUND OF THE INVENTION

This invention relates generally to the field of tool accessories, and more particularly to an apparatus to hold drill motors and associated accessories on the upper torso thereby redistributing the weight from the lower back to the upper torso.

For many years trades-people have been looking for better ways to keep their tools close at hand and organized to facilitate improved job performance. The typical method being used for carrying tools on ones person is a common carpenter's or electrician's tool belt that is worn around the waist with various loops and pockets holding an assortment of tools and hardware such as hammers, drill motors, screwdrivers, channel locks, T-square, pliers, utility knives, tape measures and so on. The weight of this type of tool belt has been steadily increasing in order to carry more, bigger, and sometimes better and heavier tools. With increasing job responsibilities, trades-people are also required to carry a bigger variety of tools. Changes in tool technology have led to an increasing amount of weight transmitted to and being carried directly by the lower back of trades-people through tool belts. With the advent of cordless drill motors, some holsters were introduced to trades-people that attach to an existing tool belt, while other motors come with their own holsters. One of many problems with these holsters, even before drill motors started becoming more weighty due to additional power requirement, is that the area between the holster pocket and the belt attachment would begin to twist primarily due to weight of the battery in the handle of the drill and eventually cause the drill motor to not only become difficult to grasp in ones hand, but would actually cause the drill motor to fall out and, upon striking the hard ground or surface, would damage or completely disable the drill motor.

Cordless drill motors are becoming more and more powerful by simple market demand. Because batteries are an integral part of their construction, the more powerful they become, the heavier they become. This invention redistributes the weight load of the drill motor and the device itself to the upper body thereby decreasing the weight that the lower back must otherwise directly support. In addition, the attachable and detachable drill motor bit and accessory holder for containing associated and non-associated objects in accordance with the preferred embodiment of the invention allows for, among other things, multiple drill bits to be organized and easily accessed during the course of a job.

SUMMARY OF THE INVENTION

One object of the invention is to provide a better way to ergonomically carry a drill motor without additionally straining the lower back.

Another object of the invention is to provide a more convenient way to contain drill motors while maintaining close proximity for use.

A further object of the invention is to provide a better way to ergonomically carry associated drill motor bits and accessories.

Another object of the invention is to provide a better way to ergonomically carry tools without additionally straining the lower back.

A further object of the invention is to provide a better way to ergonomically carry non-associated accessories.

A still further object of the invention is to provide a pouch for a drill motor that is separate from the waist tool pouch allowing for redistribution of that weight to the upper torso.

A further object of the invention is improved physical human maneuverability while wearing the device.

Another object of the invention is to free up space on a conventional waist tool pouch.

A further object of the invention is to better safely store a drill motor.

A still further object of the invention is the better ability to safely store associated and non-associated.

Another object of the invention is the better accessibility it affords the user to objects stored within the pouch and pockets.

Yet another object of the invention is the better accessibility it affords the user to associated drill motor bits and accessories.

In accordance with a preferred embodiment of the present invention, a drill motor pouch for carrying drill motors and related accessories on the upper torso comprises a pouch angled and shaped to allow for drill motor insertion and extraction; and a fully adjustable strap assembly attached to the pouch to support the pouch and drill motor while distributing the weight about the user's upper torso. The safety strap secures the drill motor in the pouch despite physical exertion of the wearer. The pouch may also be designed separately for both right- and lefthanded persons and has a padded strap for the shoulder and neck area, as well as a pocket on the front of the drill motor pouch for drill motor accessories.

Other objects and advantages of the present invention will become apparent from the following descriptions, taken in connection with the accompanying drawings, wherein, by way of illustration and example, an embodiment of the present invention is disclosed.

The attachable and detachable drill motor bit and accessory holder for containing associated and non-associated objects keeps drill motor bits conveniently located on the shoulder strap or anything else it can wrap around. The attachable and detachable drill motor bit and accessory holder for containing associated and non-associated objects may have a plurality of accessory storage capabilities on the front of the attachable and detachable drill motor bit and accessory holder.

BRIEF DESCRIPTION OF THE DRAWINGS

The drawings constitute a part of this specification and include exemplary embodiments to the invention, which may be embodied in various forms. It is to be understood that in some instances various aspects of the invention may be shown exaggerated or enlarged to facilitate an understanding of the invention.

The above described embodiments of this invention are merely descriptive of its principles and are not to be considered limiting. The scope of this invention shall instead be determined from the scope of the claims.

DETAILED DESCRIPTION OF THE PREFERRED EMBODIMENTS

Detailed descriptions of the preferred embodiment are provided herein. It is to be understood, however, that the present invention may be embodied in various forms. Therefore, specific details disclosed herein are not to be interpreted as limiting, but rather as a basis for the claims and as a representative basis for teaching one skilled in the art to employ the present invention in virtually any appropriately detailed system, structure or manner.

Figure 1:
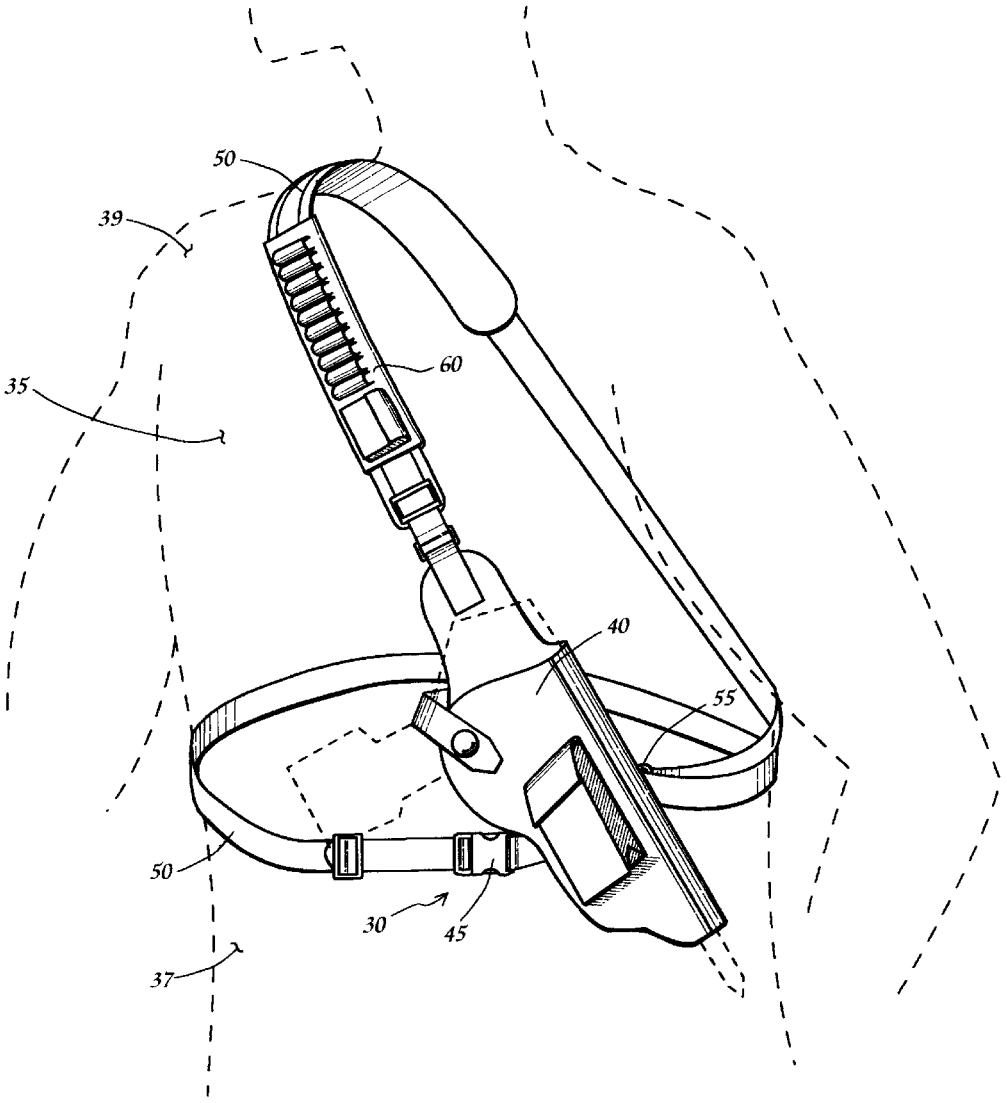
FIG. 1 is a front perspective view of the shoulder pouch assembly with the attachable and detachable drill motor bit and accessory holder for containing associated and non-associated objects applied to the widened and padded shoulder strap adjoining the waist strap assembly to the back pouch containment assembly, and as it would appear when worn by a right handed person.

Turning first to FIG. 1, the drill motor shoulder pouch assembly 30 is shown being worn on the upper torso 35 of a user with the drill motor pouch 40 positioned at the front and above the waist 37 of the upper torso 35. It is to be noted that drill motor pouch 40 is configured with angles to accommodate various sized and shaped drills and drill motors. It is secured to the upper torso 35 with the use of a fully adjustable strap assembly 50 attached to the top of the drill motor pouch 40 causing the drill motor pouch 40 to be set at an angle directed towards the shoulder of which would define the handedness of the wearer. Strap assembly 50 proceeds upward and diagonally across the upper torso 35 toward the shoulder opposite the placement of drill motor pouch 40. It should be noted that a portion of strap assembly 50 may be widened and padded for a distance to provide comfort to the wearer. The strap assembly then proceeds over that shoulder 39 returning down the back of the respective torso 35 diagonally in the direction opposite shoulder 39 to return around the waist 37 and thread through from the back to the front of the back pouch containment and guidance assembly 55. Strap assembly 50 then proceeds toward the back of the upper torso 35 at just above the waist level 37 and continues around the back of the upper torso 35 at just above waist level 37 to return to the front of the upper torso 35 and finally attach to the side pouch containment assembly 45. It is noted that the strap assembly 50 is fully adjustable and may be adjustable through a variety of conventional means such as buckle and hole, snap, or hook and loop fastener like Velcro.

One of the features of the above described invention is the attachable and detachable drill motor bit and accessory holder 60 viewed as it may be attached to the widened and padded portion of adjustable strap assembly 50.

Figure 2:
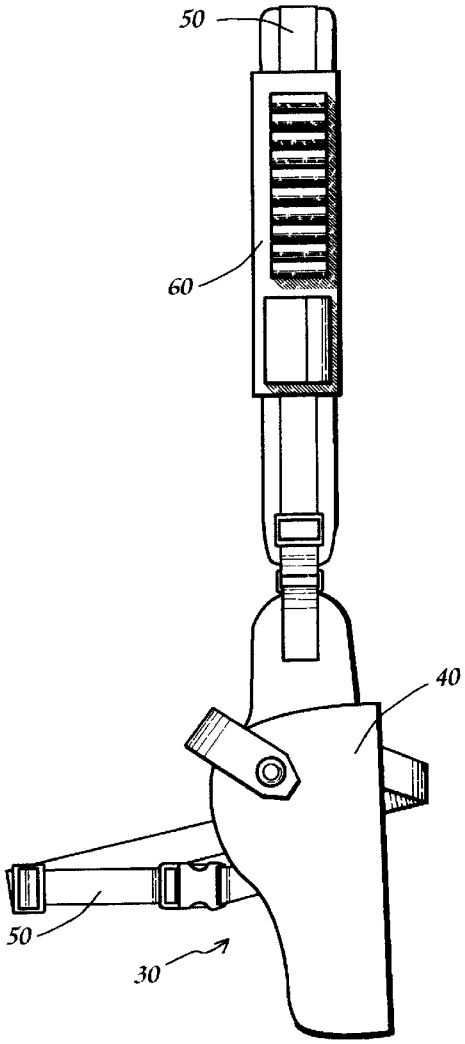
FIG. 2 is a front right-hand perspective view illustrating the pouch without accessory storage capabilities.
Figure 3:
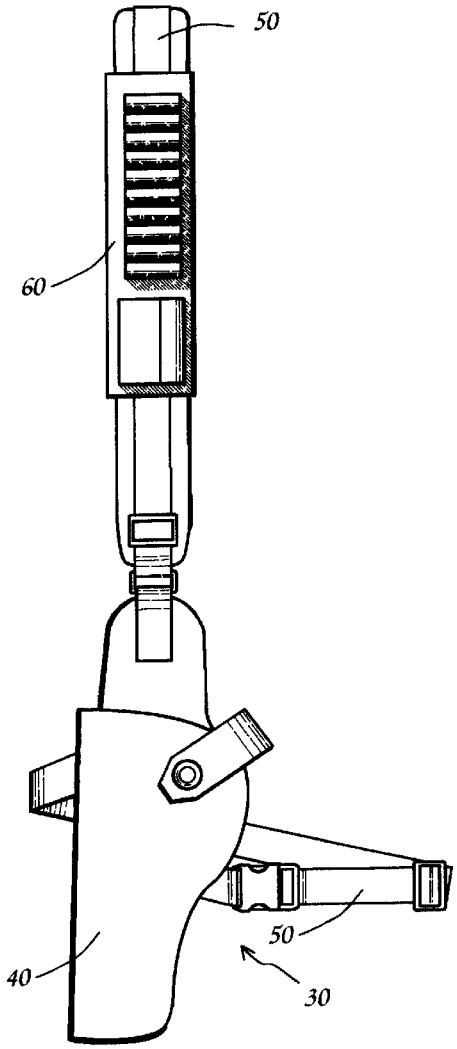
FIG. 3 is a front left-hand perspective view illustrating the pouch without accessory storage capabilities.

FIGS. 2 and 3 depict the appearance of the drill motor shoulder pouch assembly 30 with the strap assembly 50 in a right and left handed configuration respectively and without drill motor pouch accessory storage 45 as in FIG. 1.

Figure 4:
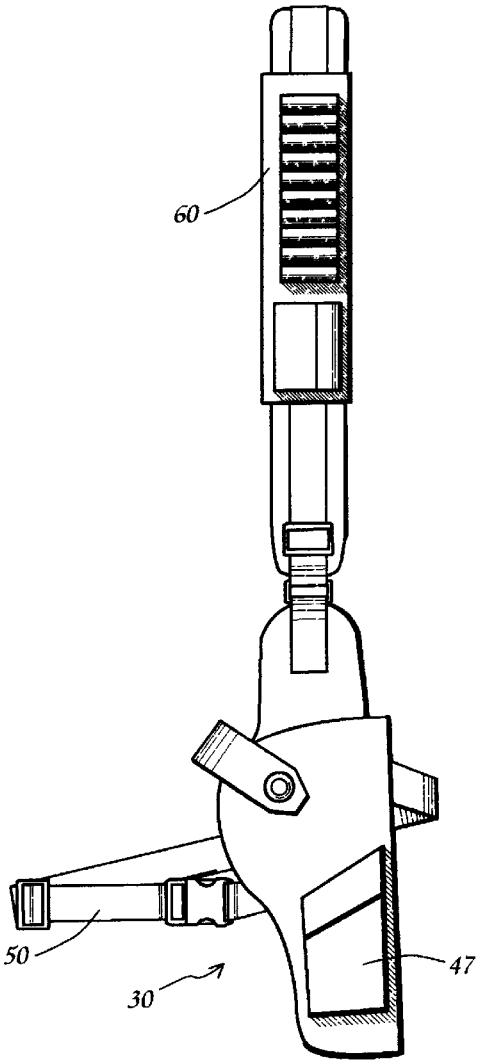
FIG. 4 is a front right-hand perspective view illustrating the pouch with closing pocket, being one of many possible drill motor pouch accessory storage capabilities.
Figure 5:
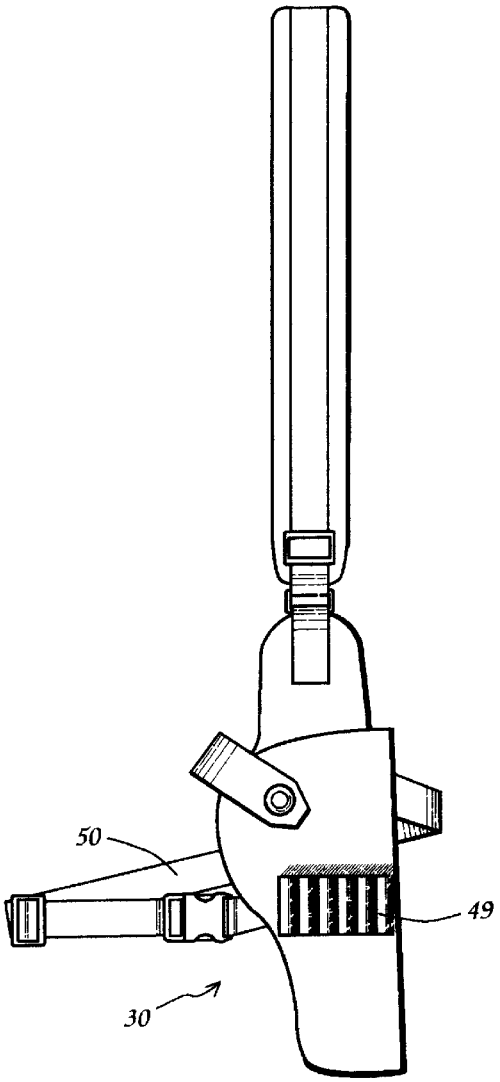
FIG. 5 is a front right-hand perspective view illustrating the pouch with individual looped sleeves, being another of many possible drill motor pouch accessory storage capabilities.
Figure 6:
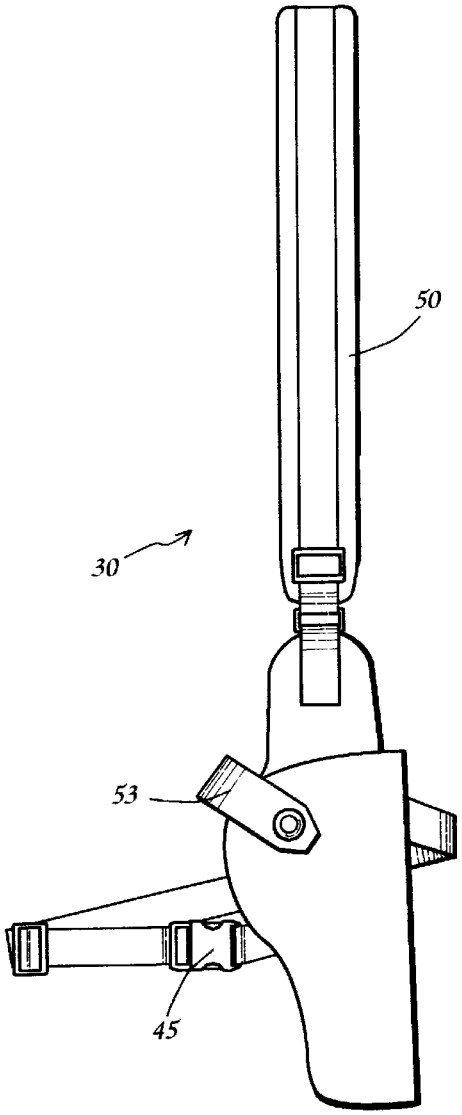
FIG. 6 is a front right-hand perspective view illustrating the pouch, safety strap front attachment to pouch, widened and padded shoulder strap, waist strap assembly and side pouch attachment and containment assembly.
Figure 7:
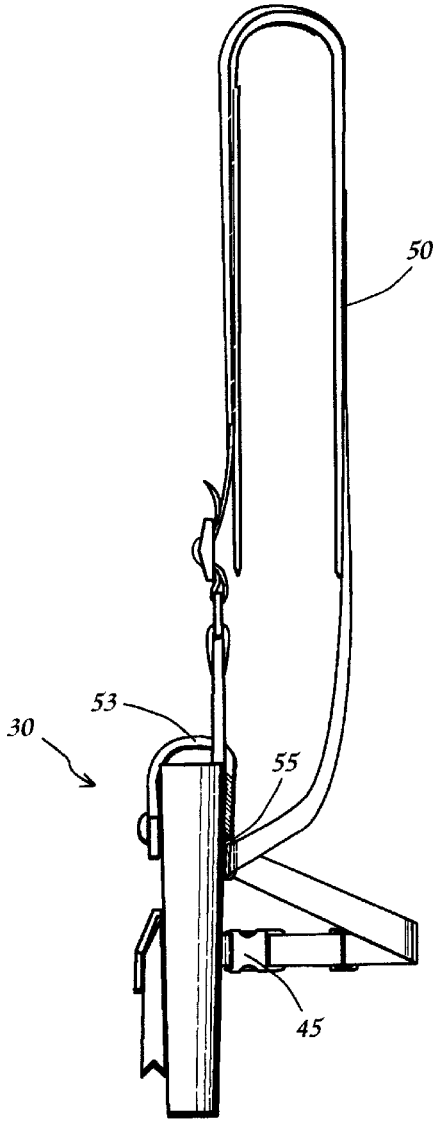
FIG. 7 is a right side of a right-hand perspective view illustrating the padded shoulder strap assembly adjoining the waist strap assembly, and the waist strap continuing as it threads through the back pouch containment and guidance assembly and with closing pocket, being one of many possible drill motor pouch accessory storage capabilities.
Figure 8:
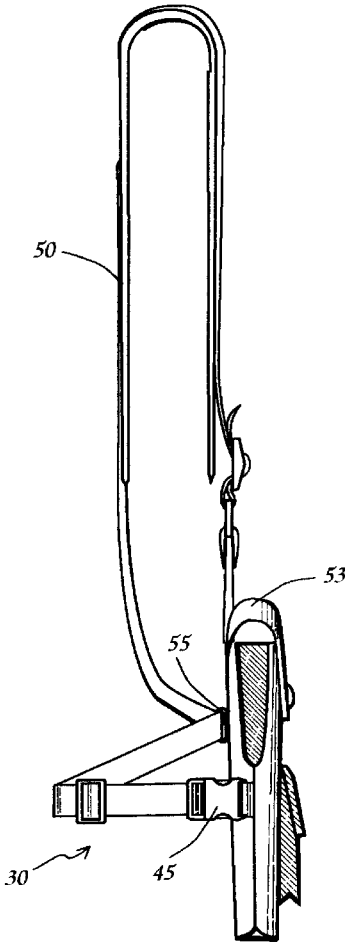
FIG. 8 is a left side of a right-hand perspective view illustrating the left view of the pouch, the widened and padded shoulder strap assembly adjoining the waist strap assembly, the waist strap continuing as it threads through the back pouch containment and guidance assembly, and continuing on to attach to the side pouch attachment and containment assembly and with individual looped sleeves, being another of many possible drill motor pouch accessory storage capabilities.
Figure 9:
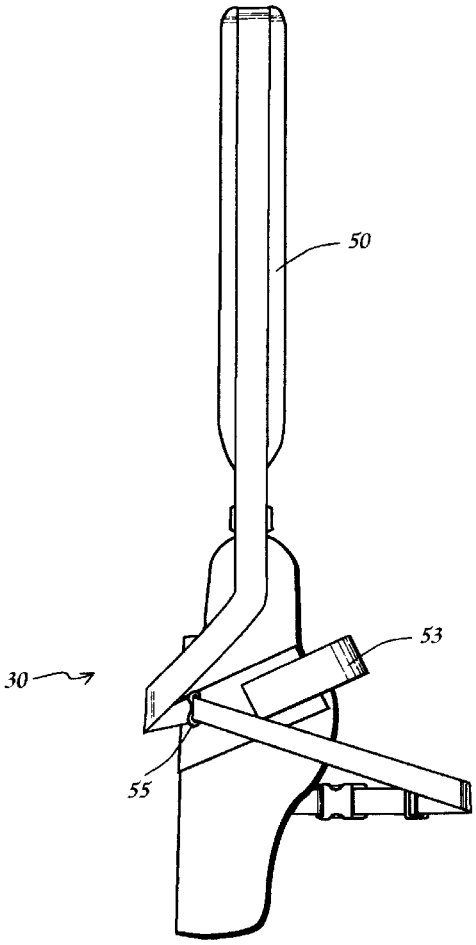
FIG. 9 is a back side of a right-hand perspective view illustrating the back of the pouch where the adjustable safety strap attaches to the pouch, the widened and padded shoulder strap assembly adjoining the waist strap assembly, the waist strap continuing as it threads through the back pouch containment and guidance assembly, and continuing on to attach to the side pouch containment and guidance assembly.

FIGS. 4 and 5 feature the appearance of the shoulder pouch 30 with and without the attachable and detachable drill motor bit and accessory holder 60 respectively in a right handed configuration with two of the many possible drill motor pouch accessory storage configurations 47, 49 being a closing pocket and looped sleeves, respectively.

FIGS. 6, 7, 8 and 9 show features from the front, right, left and back views respectively of the shoulder pouch assembly 30 wherein the front of the safety strap 53, side pouch containment assembly 45, strap assembly 50, back pouch containment and guidance assembly 55 and the back adjustable safety strap 53 are given visual detail.

Figure 10:
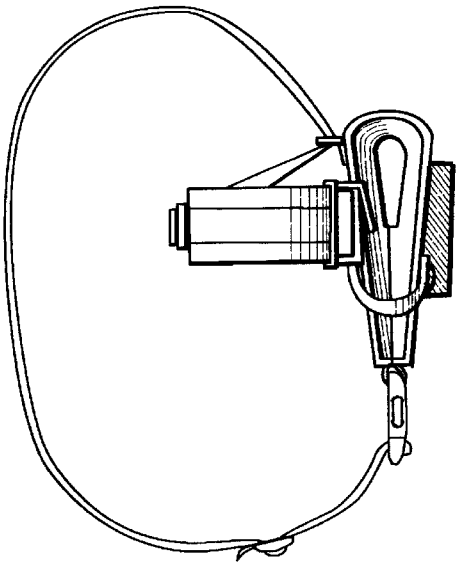
FIG. 10 is the top of a right-hand perspective view illustrating a large opening in the top of the drill motor pouch.
Figure 11:
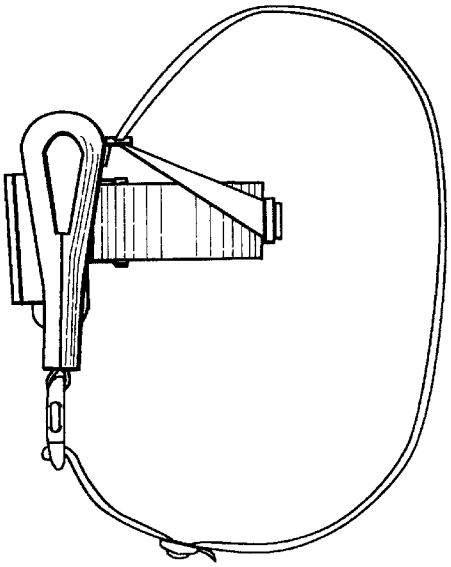
FIG. 11 is the bottom of a right-hand perspective view illustrating a small opening in the bottom of the drill motor pouch.
Figure 12:
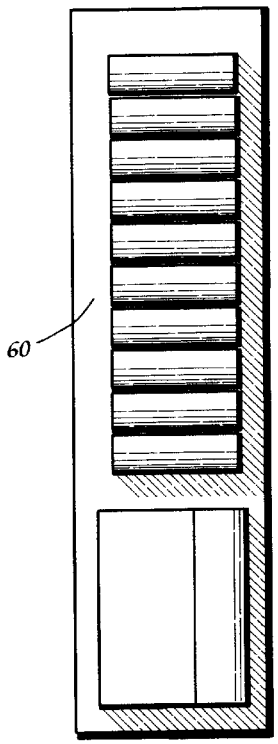
FIG. 12 is a front perspective view of the attachable and detachable drill motor bit and accessory holder showing the individual looped sleeves on the top, with the closing pocket on the bottom.
Figure 13:
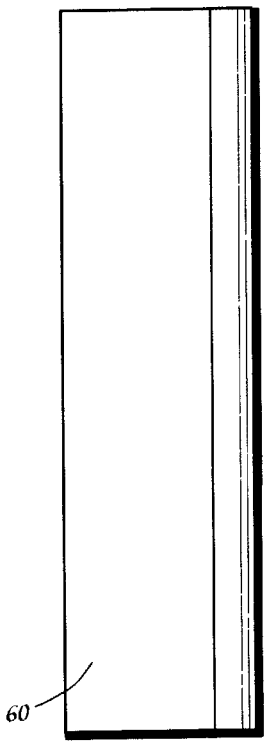
FIG. 13 is a left perspective view of the attachable and detachable drill motor bit and accessory holder with the closing pocket at the bottom left.
Figure 14:
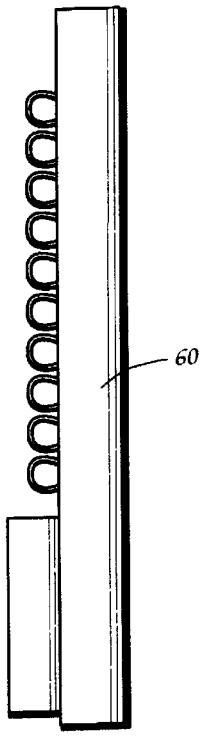
FIG. 14 is a right perspective view of the attachable and detachable drill motor bit and accessory holder with the closing pocket at the bottom right.
Figure 15:
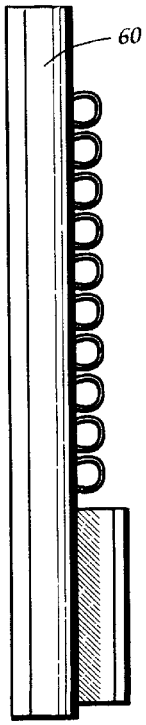
FIG. 15 is a back perspective view of the attachable and detachable drill motor bit and accessory holder in its closed position showing the overlapping ends at the right.

FIGS. 10 and 11 feature the top and bottom views respectively of the drill motor shoulder pouch assembly in a right handed configuration enabling visual realization of its ability to accept a wide range of shaped and sized drill motor insertion capabilities at the top while also allowing for possible drill motor chuck held tool protrusion at the bottom as shown in FIG. 1.

Turning now to FIGS. 12, 13, 14 and 15 which feature the front, back, right and left views respectively of the attachable and detachable drill motor bit and accessory holder with a possible velcro attachment configuration.

Figure 16:
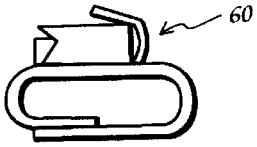
FIG. 16 is a bottom end perspective view of the attachable and detachable drill motor bit and accessory holder as viewed in FIG. 12.
Figure 17:
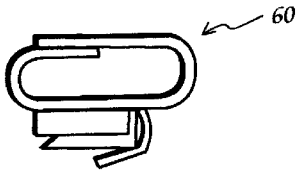
FIG. 17 is a top end perspective view of the attachable and detachable drill motor bit and accessory holder as viewed in FIG. 12.

FIGS. 16 and 17 feature the top and bottom views depicting the way in which the detachable drill motor bit and accessory holder may attach around strap 50.

The drill motor pouch has two separate design configurations, one for lefthanded people and one for right-handed people. Each of the two designs and the fully adjustable strap assembly were made to intentionally make the total assembly visually obvious and without intent to make the invention concealable.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined by the appended claims.

What is claimed is:

1. A carrier for distributing weight around the torso of a wearer, said carrier comprising:

a holster including a guide; and a harness extending over one shoulder and around the waist of the wearer, said harness passing through said guide, both ends of said harness coupled to said holster.

2. The carrier of claim 1 wherein said harness comprises a single-branch non-divergent strap.

3. The carrier of claim 2 wherein said strap comprises a plurality of longitudinal segments.

4. The carrier of claim 2 wherein said harness includes a fastener joining the segments of said strap that extend around the waist of the wearer.

5. The carrier of claim 4 wherein said holster has a right-handed configuration.

6. The carrier of claim 4 wherein said harness includes adjustment means for providing said harness with continuous adjustability.

7. The carrier of claim 6 wherein said holster has a left-handed configuration.

8. The carrier of claim 2 further including a removable accessory holder comprising:

a storage pocket on said removable accessory holder;

a plurality of looped sleeves on said removable accessory holder; and means for attaching said removable accessory holder to said strap.

9. The carrier of claim 2 wherein said holster includes at least one storage pocket.

10. The carrier of claim 2 wherein said holster includes a plurality of looped sleeves.

11. The carrier of claim 2 wherein said holster includes a plurality of peripheral storage compartments.

12. The carrier of claim 2 wherein said harness widens along the portion of said strap extending over one shoulder of the wearer.

13. The carrier of claim 2 wherein said harness has padding along the portion of said strap extending over one shoulder of the wearer.

14. A tool carrier for distributing weight around the torso of a wearer, said tool carrier comprising:

a holster having a back, a top, and a side;

a harness guide mounted on the back of said holster; and a single-branch non-divergent harness extending over one shoulder of the wearer, passing through said guide, and extending around the waist of the wearer, one end of said harness attached to the top of said holster, the other end of said harness attached to the side of said holster, said harness including a buckle.

15. The tool carrier of claim 14 wherein said harness comprises a plurality of longitudinal segments, said buckle joining the segments of said harness extending around the waist of the wearer.

16. The tool carrier of claim 15 wherein said harness includes adjustment means for providing said harness with continuous adjustability.

17. The tool carrier of claim 15, further including a removable accessory holder comprising:

a storage pocket on said removable accessory holder;

a plurality of looped sleeves on said removable accessory holder; and means for attaching said removable accessory holder to said harness.

18. The tool carrier of claim 17 wherein said holster further includes a plurality of peripheral storage compartments.

19. The tool carrier of claim 18 wherein said harness widens and has padding along the segment extending over one shoulder of the wearer.

* * * * *